US011548773B1

(12) United States Patent
Flowers et al.

(10) Patent No.: US 11,548,773 B1
(45) Date of Patent: Jan. 10, 2023

(54) MULTIPURPOSE VENTED FUNNEL

(71) Applicants: Jeffrey Flowers, Grass Valley, CA (US); Karen Flowers, Grass Valley, CA (US)

(72) Inventors: Jeffrey Flowers, Grass Valley, CA (US); Karen Flowers, Grass Valley, CA (US)

( * ) Notice: Subject to any disclaimer, the term of this patent is extended or adjusted under 35 U.S.C. 154(b) by 0 days.

(21) Appl. No.: 17/387,742

(22) Filed: Jul. 28, 2021

(51) Int. Cl.
*B67C 11/02* (2006.01)
*B67C 11/00* (2006.01)

(52) U.S. Cl.
CPC ..... *B67C 11/02* (2013.01); *B67C 2011/30* (2013.01)

(58) Field of Classification Search
CPC ..... B67C 11/02; B67C 2011/30
USPC ..... 141/300
See application file for complete search history.

(56) References Cited

U.S. PATENT DOCUMENTS 3,177,907 A * 4/1965 Baldi ..... B67C 11/04 141/344
5,511,595 A * 4/1996 Stidham ..... B67C 11/04 141/297
6,142,193 A * 11/2000 Sanders ..... B67C 11/02 141/331
2019/0322515 A1* 10/2019 Liao ..... B67C 11/02

FOREIGN PATENT DOCUMENTS

GB 2388801 A * 11/2003 ..... B65B 39/04

* cited by examiner

*Primary Examiner* — Jason K Niesz

(57) ABSTRACT

A multipurpose vented funnel is a device for funneling liquid, wherein the device includes a conical hollow body having open top end directed into an outlet spout end, with an inner and outer wall wherein the inner wall of the conical hollow body includes a linear pattern of grooves extending vertically from the bottom of the overflow guard and ended at the spout opening. The conical hollow body has a handle with is integrated and part of tubular rectangular vent passageway structure for the venting of air or gas from a reservoir and/or container. In addition, a plurality of stabilizer tabs outwardly project from the down spout for the stable supporting of a containers.

4 Claims, 8 Drawing Sheets

MULTIPURPOSE VENTED FUNNEL

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention relates to a funnel having multiple features and functions, and more particularly, an multipurpose vented funnel having an integrated self-venting system for use in filling reservoir and/or containers.

BACKGROUND OF THE INVENTION

Conventional funnels are typically used to facilitate the pouring of liquids, powders, or any other filler material into reservoirs and/or containers that have multiple size opening. A funnel typically includes inverted hollow cones or tapering or cylindrical tubes having a wide opening at the top and a narrow spout opening designed to be fitted into the openings of associated receptacles into which material is to be poured.

Closed or sealed fluid systems such as the cooling and oil system of a motor vehicle include a fill port or nozzle through which fluids are introduced or added. Similarly containers, such as bottles include an opening through which the fluid or solid material is introduced to fill the container. It is common practice to use a funnel inserted into the container opening or system port/nozzle to fill or add the material to these containers or sealed systems.

Funnels are often used in the filling process of liquids, powder and/or filler material into household containers. Funnels are commonly known and used to prevent spilling in pouring liquids into containers with small openings. A household funnel may include a small tapering tube with a wide, cone-shaped mouth; however, this common design often causes liquid to bottleneck and backup therein.

In food dispensing establishments, such as restaurants, cafeterias, luncheonettes, and coffee shops may have problems in the use of relatively viscous liquid condiments, such as ketchup, mustard and the like. These problems arise from the fact that conventional packaging for these condiments are done in clear glass bottles having a relatively narrow neck. In view of the forgoing aspects, traditional funnels are undesirable for many reasons. Specifically, when liquid backs up in the funnel it causes difficulty arises from the fact that the surface tension of the relatively viscous fluid is such as to preclude facility of flow through the neck of the bottle, thus making it necessary to shake the bottle vigorously, often with disastrous results.

For most prior art funnels, venting is accomplished in one of two ways. In one case, the venting is accomplished primarily through the fill hole in the funnel. That is, the funnel's fill hole is used to add material to the container/system as well as to vent the air. Depending upon the sealing ability of the funnel to the opening/nozzle some venting also may occur in the space between the funnel and the inside surface of the opening port or nozzle. Alternatively, the funnel is held so it does not contact the nozzle or opening while adding the material. This leaves a space between the funnel and the inside surface of the opening port or nozzle in which the funnel is inserted. The air from the container system vents through this space.

In view of the above descriptions, traditional funnels are undesirable for many reasons. Specifically, when liquid backs up in the funnel it causes unwanted spillage due once the air traps inside the reservoir or container. It is also known to provide funnels in sets of different sizes for different applications. However, heretofore, such sets of different-sized funnels have not been characterized by designs which facilitate compact, nested storage. It is also known to provide funnels with handles to facilitate grasping in use. However, heretofore, such handles have tended to impair the nesting of sets of funnels and have either been relatively large or have been difficult to grasp, securely, particularly for people with impaired grasping ability.

BRIEF DESCRIPTION OF THE INVENTION

The primary object of the present invention is to provide a multipurpose vented funnel with a self-contained venting system which is designed to rapidly vent air or gas in a safe manner from a container being filled without being splashed or without spilling liquid.

In order to achieve this aspect, the present invention includes a passage way within the funnel conical member and handles structure between the inner and outer walls of the said invention. The passage way is preferably elongated and substantially rectangular in shape.

The present invention includes an funnel portion for receiving liquid, vented rectangular handle for preventing liquid backup in the funnel portion and an outlet spout with an end for delivery liquid therefrom.

The present invention may further include within the funnel inner sidewall, conical grooves to prevent the spatters and blockage, extending linearly and generally vertically from the top of the funnel to the top of the down spout.

In yet another aspect of the invention, the downspout of the funnel having stabilizes tabs outwardly project from the tubular spout for stably supporting the funnel in a generally upright orientation when positioned within an opening of a receiving container.

The present invention solves the problems of conventional funnel by improving standard funnel and providing a multipurpose vented funnel that accommodates various functions within the household, auto, restaurants, while incorporating different sizes and a means for the air to escape out of a container for which a funnel is being used.

These and other features and advantages of the invention will be readily apparent from the following detail description of an embodiment thereof and reference to the accompanying drawings.

DESCRIPTION OF CERTAIN EMBODIMENT OF THE PRESENT INVENTION

In the following detailed description of the preferred embodiment, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
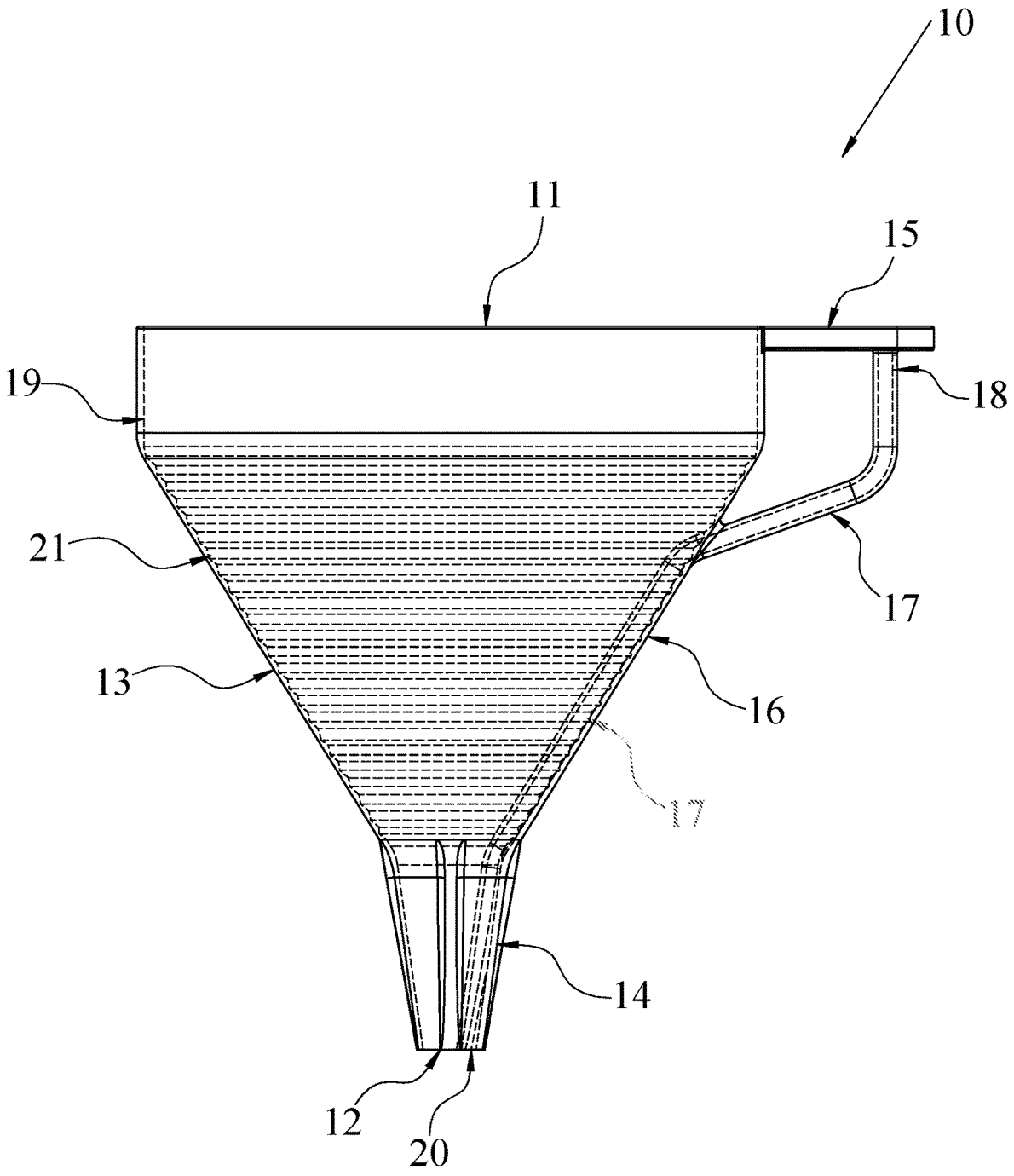
FIG. 1 is a front schematic view of the multipurpose vented funnel in accordance with the present embodiment of the invention.

The present invention shown in FIG. 1 illustrate the multipurpose vented funnel 10 comprises a top end opening 11 for receiving liquid, a bottom opening 12 for the dispense of said liquid is comprise of a conical hollow body 13 elongating into an outlet spout 14, a handle 15 attached to outer wall 16 includes the tubular rectangular vent passageway 17 exhaust vent 18. The inner wall 19 includes the groove 21 of the conical hollow body 13 with the vent passageway 17 continuing from the handle 15 into the outlet spout 14 terminating where the air intake 20 is located.

Figure 2:
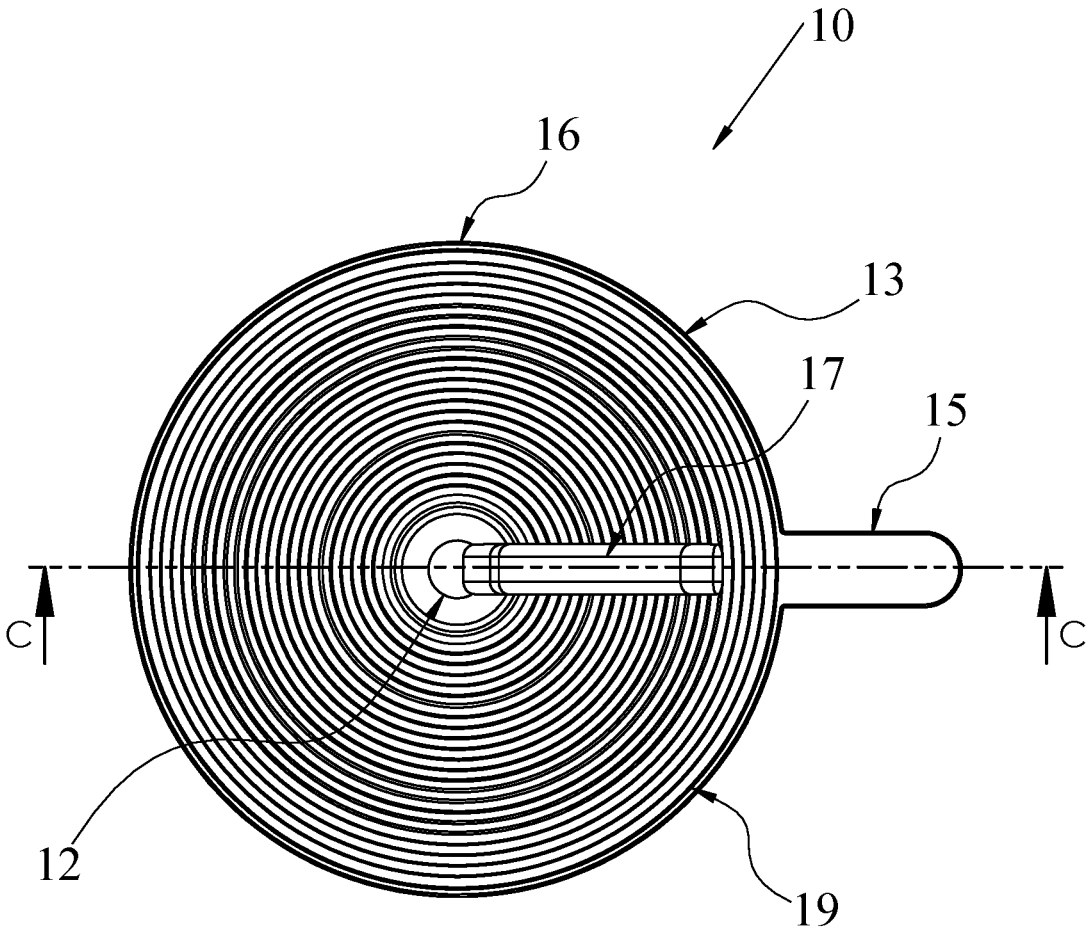
FIG. 2 is a top view of multipurpose vented funnel shown in FIG. 1.

As shown in FIG. 2 is a top view of the multipurpose vented funnel 10 having an conical hollow body 13 with a handle 15 attached to the outer wall 16 includes an inner wall 19 vent passageway 17 terminating at the bottom opening 12.

Figure 3:
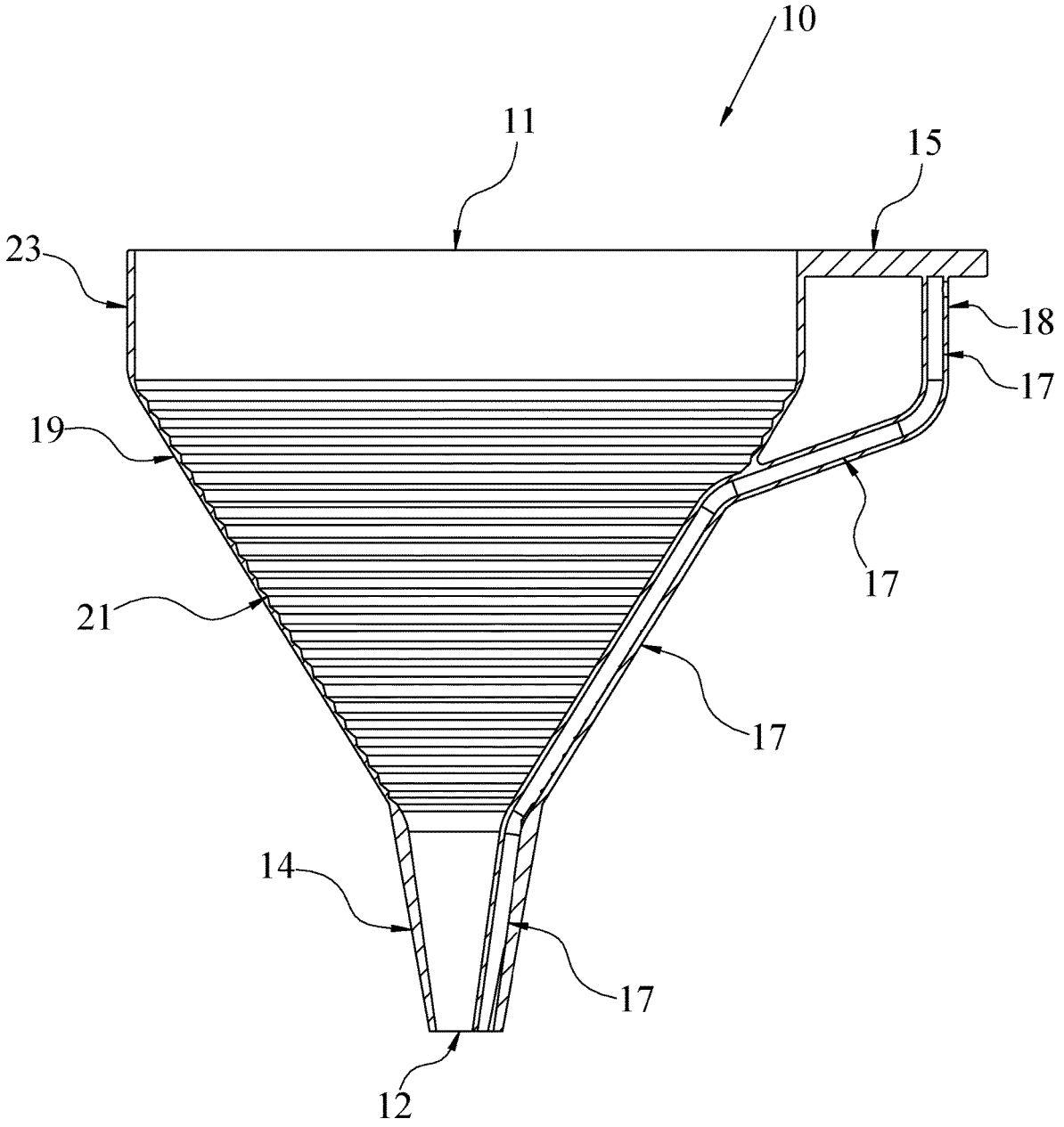
FIG. 3 is a cross sectional view taken along the lines C-C of FIG. 2, of the present invention showing the passageway.

More specifically, as shown in FIG. 3 is a cross section view of the multipurpose vented funnel 10 showing the top end opening 11 and the bottom opening 12 wherein the grooves 21 are extending vertically along the inner wall 19 in a linear pattern from the bottom of the overflow guard 23 stopping at the opening of the outlet spout 14. In addition, the vent passageway 17 is shown traveling from the outlet spout 14 thru the inner wall 19 and into the handle 15 and out the handle vent 18.

Figure 4:
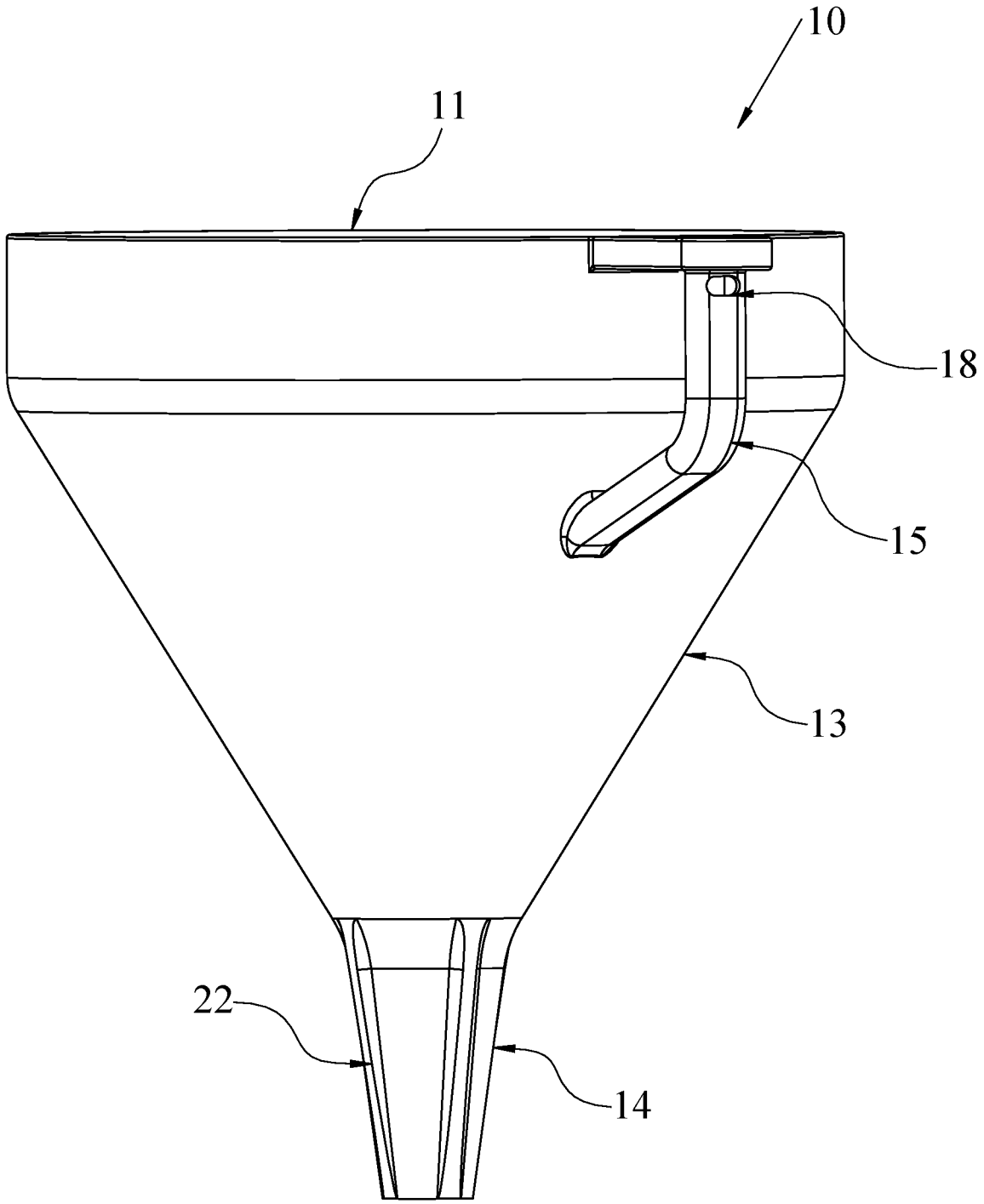
FIG. 4 is a perspective view of the multipurpose vented funnel constructed in accordance with the present embodiment of the invention.

As generally shown in FIG. 4 is a perspective view of the multipurpose vented funnel 10 rigid construction hollow body 13 includes a handle 15 with the exhaust vent 18 location. In addition, the outlet spout 14 is shown with the projecting stabilizer tabs 22 constructive coextensively periphery with the outlet spout 14 arrangement provides for stable connection.

Figure 4A:
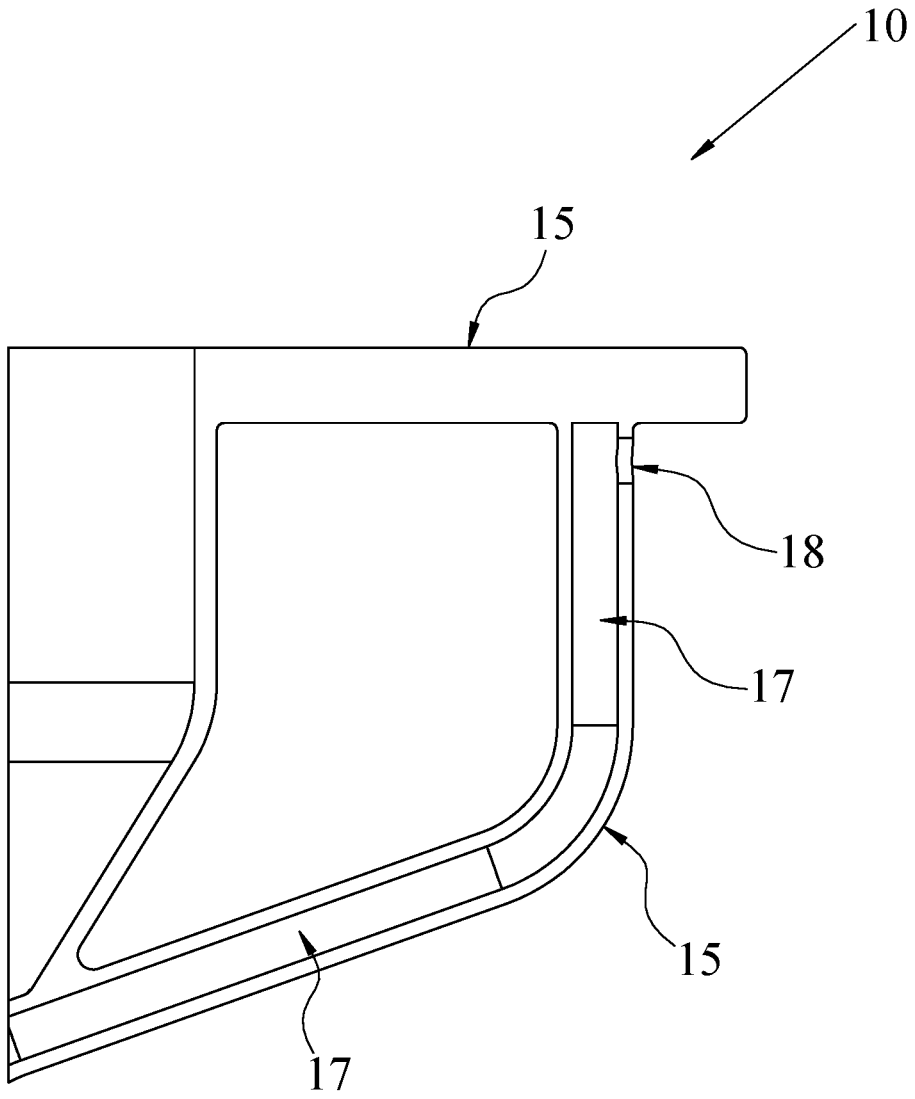
FIG. 4A is a cross sectional view of the handle vent of FIG. 4, of the present invention.
Figure 5:
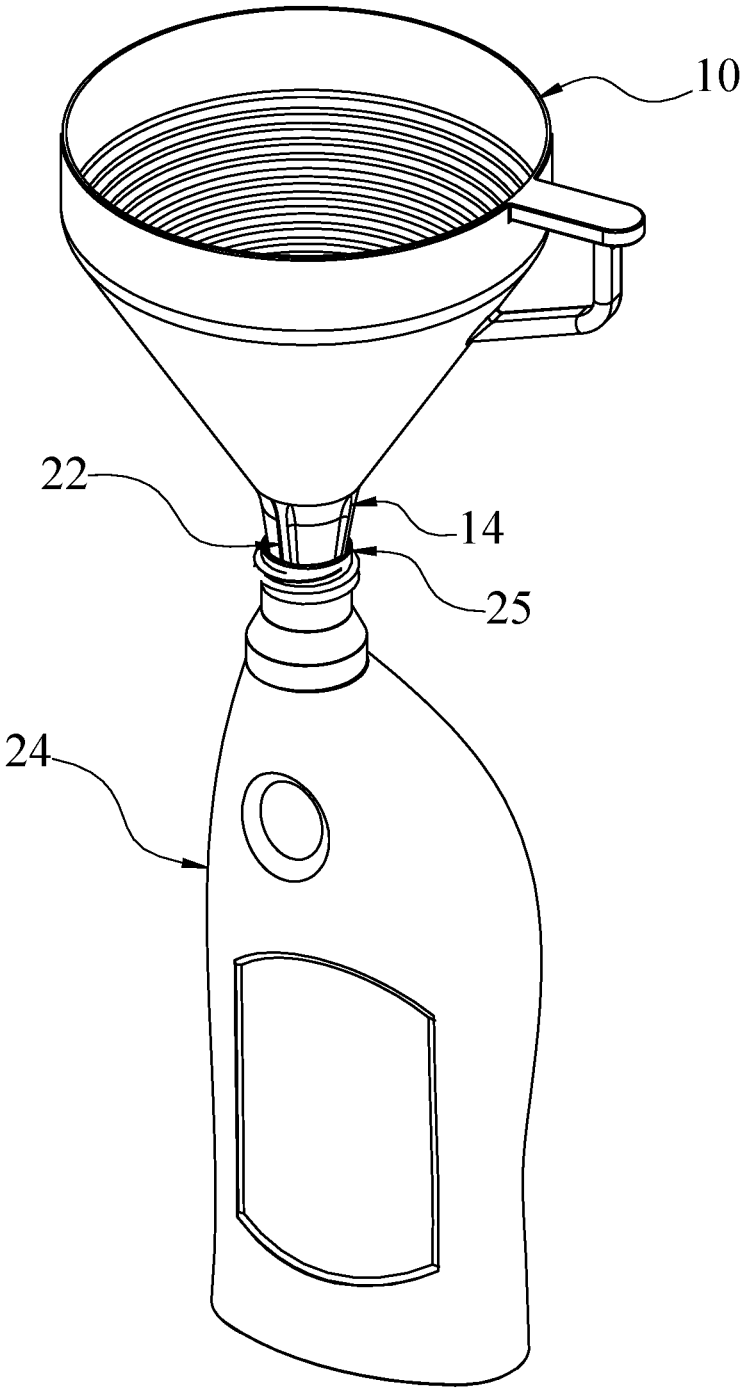
FIG. 5 is an illustration of the multipurpose vented funnel secured to the filling device according to the present invention.
Figure 6:
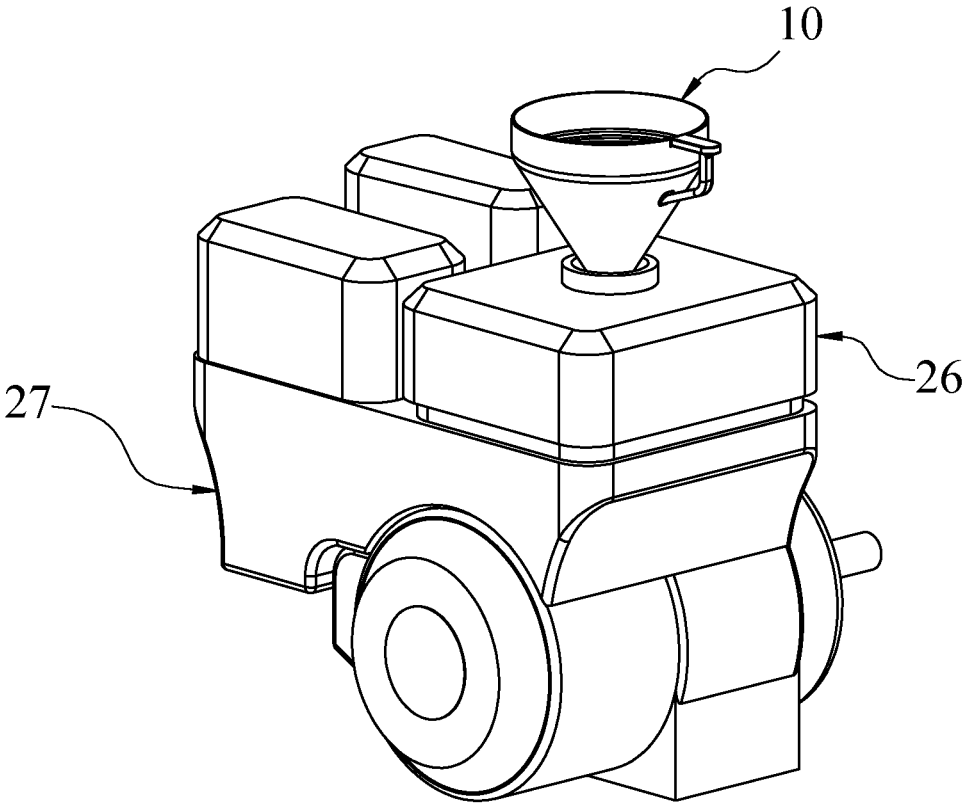
FIG. 6 is an illustration of multipurpose vented funnel of the present invention engaged with a mechanical device reservoir.
Figure 7:
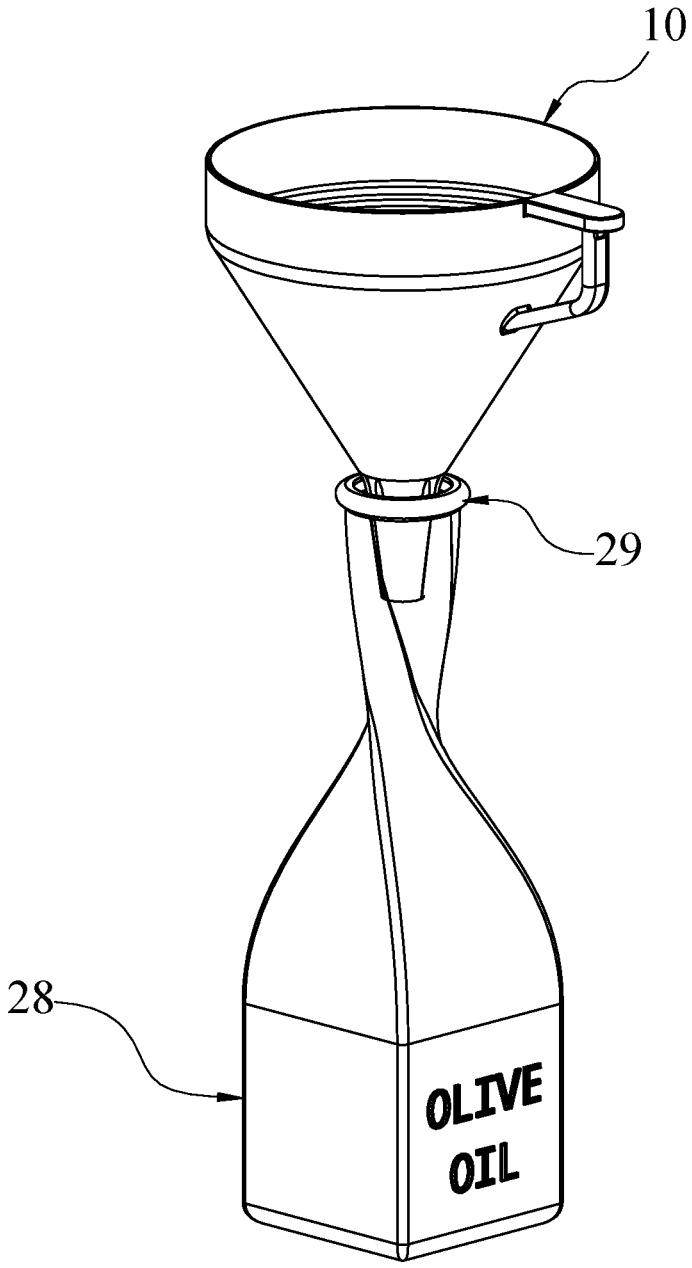
FIG. 7 is an illustration of multipurpose vented funnel of the present invention with a household container.

As best seen in FIG. 4A is a cross section view of the multipurpose vented funnel 10 having the vent passageway 17 located within the handle 15 and showing in detail the location of the handle vent 18.

as shown in FIG. 5 is an illustration of the multipurpose vented funnel 10 engaged in the filling process with an soap dispenser 24 highlighting the stabilizer tabs 22 located on the outlet spout 14 keeping the vended funnel 10 nested and from dislodging from the soap dispenser opening 25.

more specifically, as shown in FIG. 6 illustrate the multipurpose vented funnel 10 in relationship suitable for filling various reservoir 26 with may be attached to an engine motor 27, and/or other type of reservoir, for example automotive vehicle (not shown).

moreover, as show in FIG. 7 is another illustration of the multipurpose vented funnel 10 showing the transfer of liquid from the multipurpose vended funnel 10 into a container 28.

What is claimed is:

1. A multipurpose vented funnel comprising: a conical hollow body having a wide end inlet, a narrow end outlet, an inner wall surface, and an outer wall surface, the inner and outer wall surfaces extending from the wide end inlet to the narrow end outlet; and, a handle extending from the outer wall surface at the wide end inlet, the handle having an upper handle surface and a lower handle surface;

and, an outlet spout extending from the narrow end outlet of the conical hollow body, wherein the outlet spout comprises stabilizing strips disposed on an exterior surface of the spout, to adapt the multipurpose vented funnel to fill containers of varying size openings;

and, a tubular vent passageway extending along an inner surface of the outlet spout, said tubular vent passageway continuing along the inner wall surface of the conical hollow body from the narrow end outlet in a direction toward the wide end inlet, and wherein said tubular vent passageway extends through the inner and outer wall surfaces of the conical hollow body and into contact with the lower handle surface, forming a gap between a portion of the tubular vent passageway and the outer wall surface of the conical hollow body.

2. The multipurpose vented funnel of claim 1, wherein the outlet spout comprises a lower discharge opening opposite a connection between the outlet spout and the narrow end outlet of the conical hollow body, and wherein the wide end inlet of the conical hollow body has a diameter which is greater than a diameter of the lower discharge opening, such that the multipurpose vented funnel is suitable for filling reservoirs and narrow lipped containers.

3. The multipurpose vented funnel of claim 1, wherein the tubular vent passageway comprises an exhaust vent positioned at a junction between the tubular vent passageway and the lower handle surface.

4. The multipurpose vented funnel of claim 1, wherein the conical hollow body comprises grooves extending along the inner wall surface in a spaced relation from each other and arranged such that the grooves prevent splatters and blockage during transfer of material using the multipurpose vented funnel.

* * * * *